US005325032A

United States Patent [19]

Thompson et al.

[11] Patent Number: 5,325,032

[45] Date of Patent: Jun. 28, 1994

[54] AUTOMATIC HEEL COVERING MACHINE AND PROCESS

[75] Inventors: Robin R. Thompson, La Porte County, Ind.; Charles Wolfersberger, St. Louis County; Billy Poindexter, II, Crawford, both of Mo.

[73] Assignee: Brown Group, Inc., St. Louis, Mo.

[21] Appl. No.: 75,294

[22] Filed: Jun. 11, 1993

Related U.S. Application Data

[62] Division of Ser. No. 823,187, Jan. 21, 1992, Pat. No. 5,230,114.

[51] Int. Cl.[5] ..... G05B 19/417; A43D 33/00; B25J 9/16

[52] U.S. Cl. ..... 318/568.13; 318/568.17; 12/16.2; 12/49.1

[58] Field of Search ..... 318/560, 567, 568.1, 318/568.11, 568.13, 568.17; 12/1 A, 1 B, 1 W, 16.1, 16.2, 16.6, 85, 42 R, 42.5, 47.1, 49.1

[56] References Cited

U.S. PATENT DOCUMENTS

| | | | |
|---|---|---|---|
| 1,935,979 | 11/1933 | Hubbard, Jr. . | |
| 2,022,763 | 12/1935 | Gentile . | |
| 2,029,305 | 2/1936 | Bazzoni . | |
| 2,035,551 | 3/1936 | Knight et al. . | |
| 2,171,720 | 9/1939 | Young . | |
| 2,569,070 | 9/1951 | O'Donnell . | |
| 2,972,760 | 2/1961 | Lipp . | |
| 3,631,697 | 1/1972 | Deramo et al. . | |
| 3,634,682 | 1/1972 | Gold . | |
| 4,260,940 | 4/1981 | Engelberger et al. | 318/562 |
| 4,741,236 | 5/1988 | Averill . | |
| 4,959,798 | 9/1990 | Gordon et el. | 364/513 |

*Primary Examiner*—Bentsu Ro

*Attorney, Agent, or Firm*—Polster, Lieder, Woodruff & Lucchesi

[57] ABSTRACT

A process and apparatus for automatically applying heel covers to women's heels including a rotatable work table with jigs for holding the heels fixed around the periphery. Positioned outwardly from the periphery of the table are work stations with independently programmed operating machines which are responsive to the instructions as to heel size and style which are placed into the controller for the process. The controller operates motors and air valves which control the operation and positioning of an automatic top trimmer, a seat roller, a breast notcher, upper and lower nippers, a dowel and lift inserter and a dowel setting device. Each of these is preset depending on the style and size heel being worked on. Instructions as to new styles or types can be inserted into the controller while the machine is running.

2 Claims, 14 Drawing Sheets

FIG. 15.
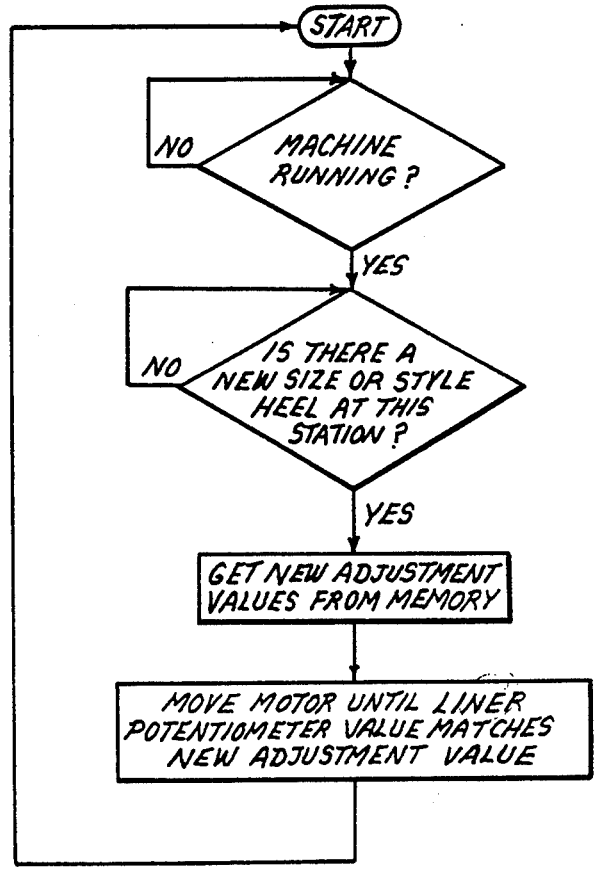
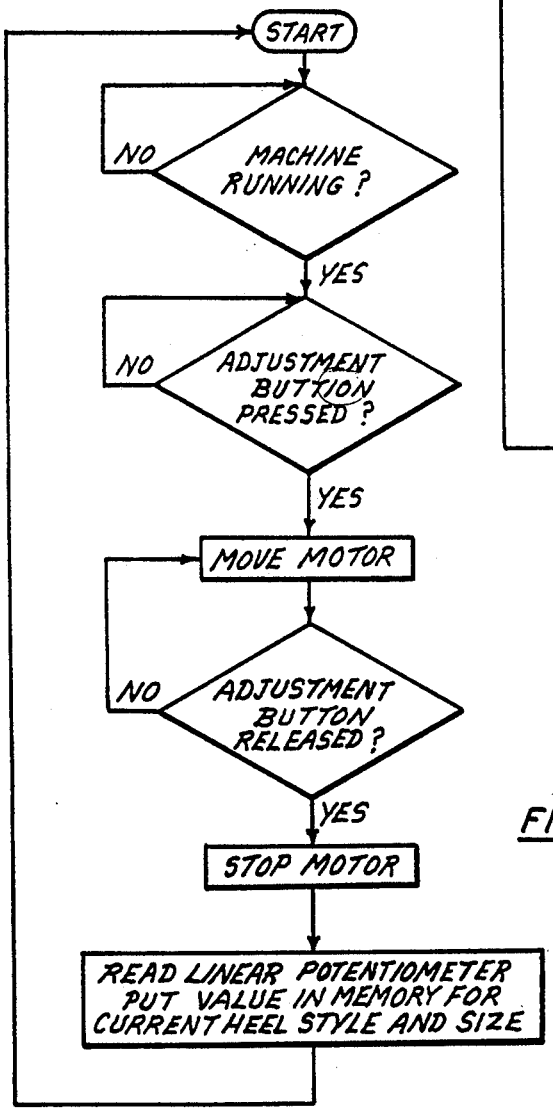
FIG. 16.

AUTOMATIC HEEL COVERING MACHINE AND PROCESS

This is a division of copending application Ser. No. 07/823,187, filed on Jan. 21, 1992, now U.S. Pat. No. 5,230,114.

BACKGROUND OF THE INVENTION

This invention relates to a unique automated method of covering shoe heels, particular women's high heels, and to a machine for applying a cloth or leather cover to a heel.

Traditionally, heels are covered in a manual operation, often involving as many as ten to twelve people per line. There are three essential components in a heel covering process, each involving several individual steps.

As a preliminary to the whole operation, the cover, usually of cloth or leather, and the heel, generally plastic, are both covered with contact cement and allowed to dry.

A typical manual operation for covering heels is as follows:

Pulling Operation

1. The heel is placed in a holding jig.
2. The cover is properly positioned with respect to the heel.
3. The cover is pulled around the back side of the heel.
4. The excess material at the lip of the heel is pinched together forming the lower ears at the heel seat.
5. The heel cover combination is removed from the jig and placed onto a belt conveyor.

These five steps are referred to as "pulling".

Trimming Operation

In the second stage of heel covering, a person picks up the heel from the belt conveyor and, using scissors and fingers, proceeds to trim away any excess material and fold the cover around the heel. This process can be broken down and listed as follows:

6. Trim excess material around the top of the heel.
7. Snip the cover in the breast area to allow for proper folding.
8. Fold the cover over the breast and press down.
9. Fold the cover over the top of the heel and press down forming upper ears at the top of the heel.
10. Fold the cover around and over the heel seat.
11. Trim the excess material at the juncture of the breast and heel seat referred to as the lower ears.
12. Trim the excess material at the juncture of the breast and the top of the heel referred to as the upper ears.

At this point, the heel is placed back onto the belt conveyor.

A third person then picks up the heel and performs the following operations:

Dowel Insertion

13. Orient and insert dowel pin.
14. Place heel in press and activate the press to compress dowel into heel.

At this point, the heel is finished.

Shoes are made in batch quantities and it is not unusual for many different sizes and styles of heels to be needed on very short notice. Since each different style and size of heel requires an adjustment in the pulling, trimming and dowel application mechanisms, it is important that these adjustments be made automatically rather than manually.

It is a principal object of this invention to provide a machine and process for replacing many of the manual operations in a heel covering process.

Another object of this invention is to provide an automatic adjustment system which can be programmed for each of the many heel styles and sizes which may be run on the same machine in a day or a week. Thus, once a heel style has been run, it is in the machine's memory and can be replicated without the time consuming hand adjustments heretofore necessary.

These and other objects and advantages will become apparent hereinafter.

SUMMARY OF THE INVENTION

This invention comprises a process and apparatus for automatically applying heel covers to women's shoe heels and includes a rotatable work table, means for holding the shoe heel to which the cover is applied, trimmed and folded, and the dowel automatically installed as the heel is indexed through work stations positioned around the periphery of the table, and programmable adjustment means so that the operating machines can be automatically set to compensate for different styles and sizes of shoe heels.

DESCRIPTION OF THE DRAWINGS

In the drawings where like numbers refer to like parts wherever they occur —

FIG. 15 is a flow diagram of the automatic adjustment routine for the stations on the machine; and FIG. 16 is a flow diagram of the teaching routine for inserting new information into the memory of the machine for each new style or size heel used on the machine.

DETAILED DESCRIPTION

Figure 1:
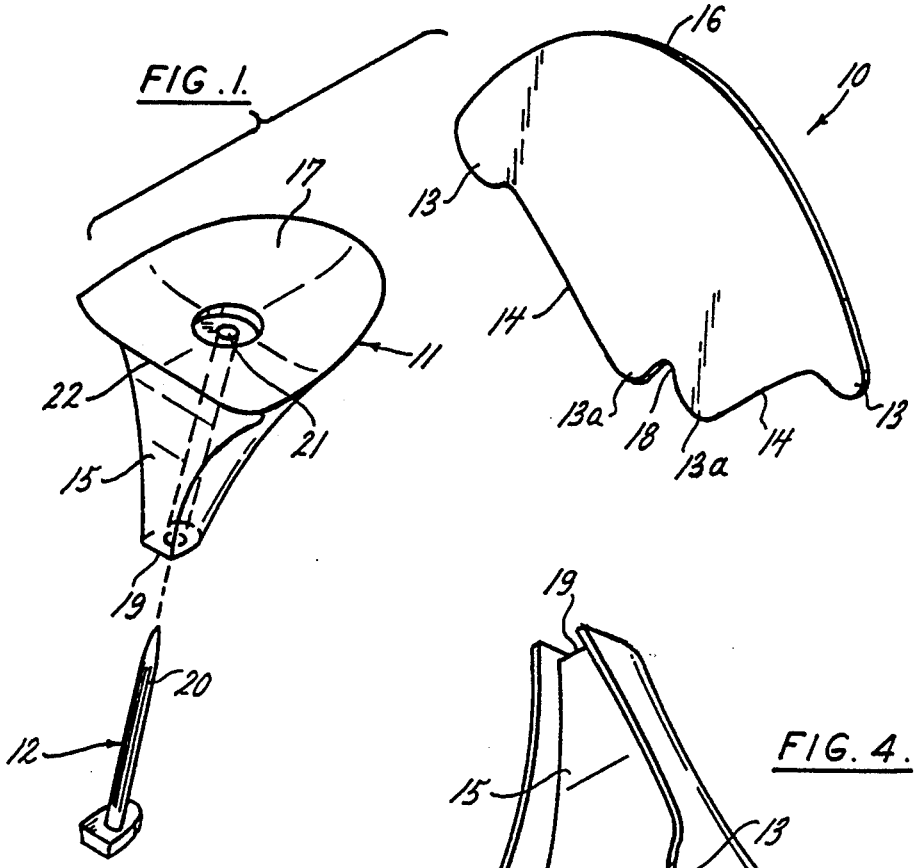
FIG. 1 is an exploded perspective view of a heel, heel lift, dowel and cover.

FIG. 1 shows a heel cover blank 10, a women's shoe heel 11 and a dowel pin and lift 12. The cover blank 10 includes ears 13 and 13*a*, breast areas 14 which fit over the heel breast 15, a curved peripheral edge 16 which is folded over the heel seat 17, and a grooved out area 18 which fits over the heel top 19 beneath the lift 12. The lift 12 includes a dowel 20 which is inserted into a throughbore 21 in the heel 11. The heel breast 15 terminates in a lip 22 adjacent to the seat 17.

Figure 2:
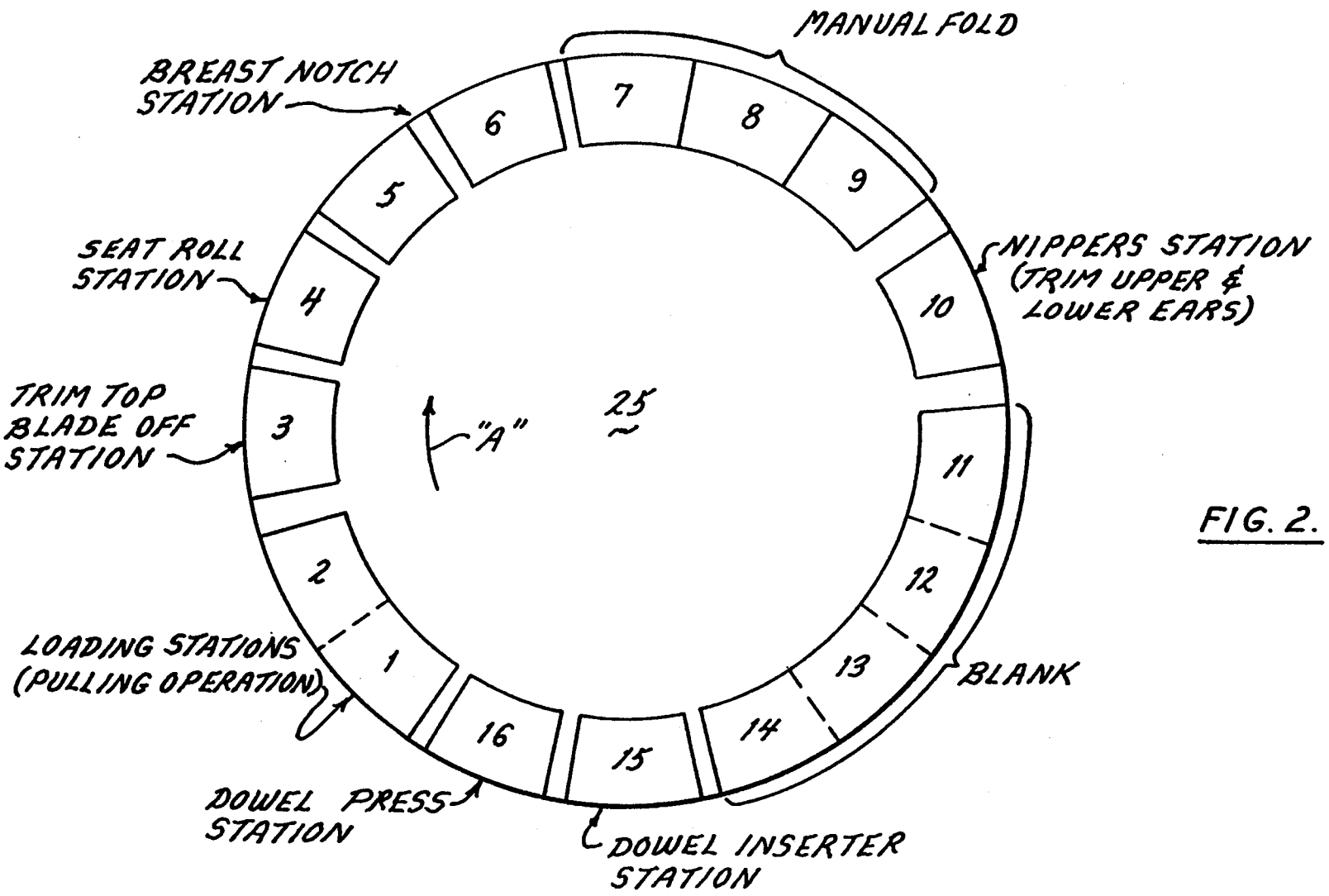
FIG. 2 is a diagrammatic representation of an indexible work table with operating stations positioned around the periphery of the table.
Figure 3:
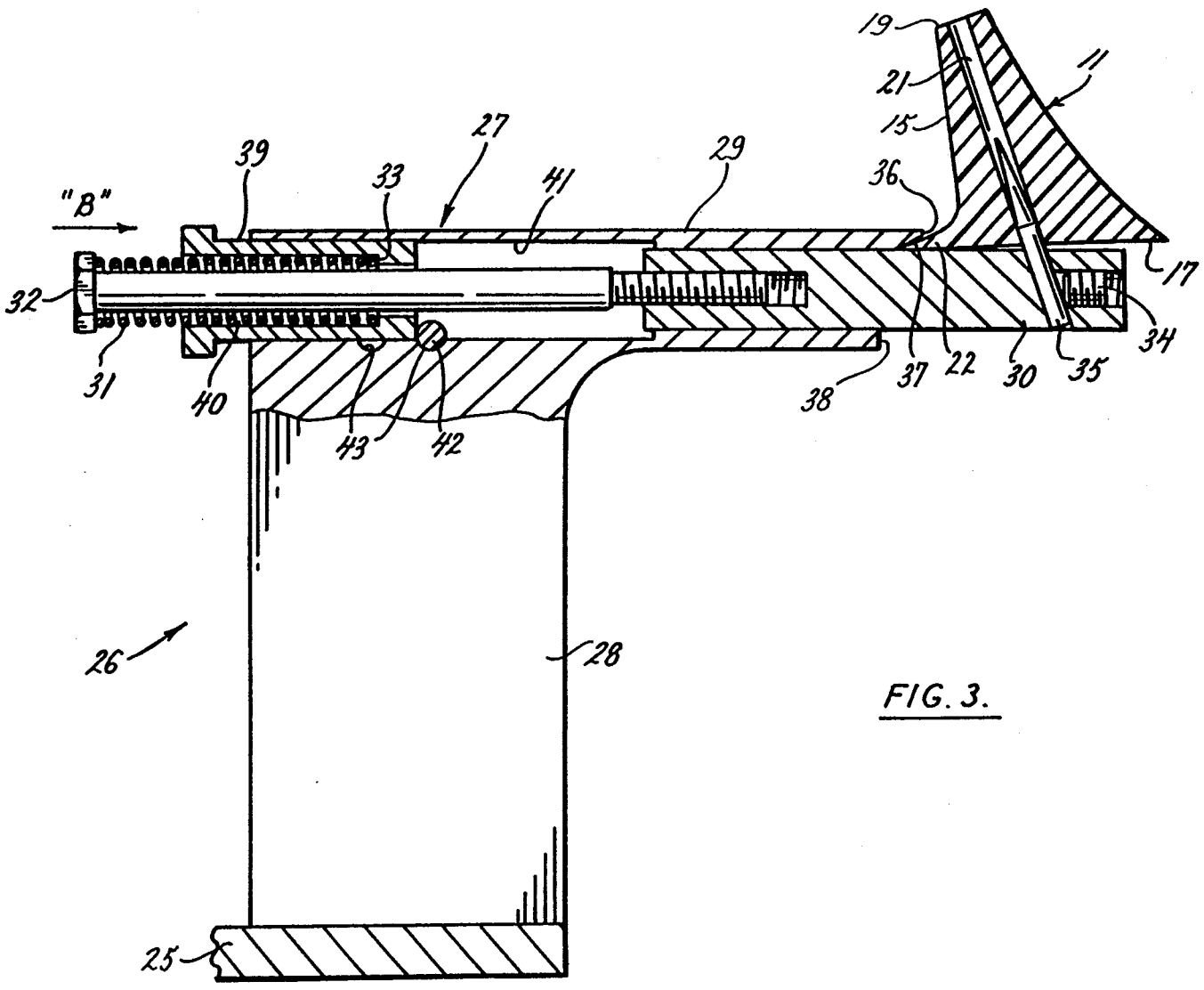
FIG. 3 is a side elevational view, partly in section and partly broken away, of the holding jigs of this invention.

FIG. 2 shows a sixteen station rotatable plate or table 25 on which are mounted holding jigs 26 (shown in FIG. 3) which hold the heel 11 and cover 10 as they progress through the operation. The plate 25 is indexed in 22½ intervals in the direction of the arrow "A" by a conventional rotary indexing unit (not shown). This type device is a conventional unit which can be purchased from many manufacturers. The jigs 26 are positioned around the periphery of the table 25.

The jig 26 is essential to this invention because it accurately positions the heel 11 beyond the periphery of the table 25 so that the various operations can be performed on a reliable and reproducible basis. With the heel 11 firmly and accurately positioned on the table 25, it is presented to the different operating stations around the periphery of the table 25 in the same position each time. Thus, the different operations can be accurately reproduced and the production of high quality heels is assured.

The jig 26 (FIG. 3) comprises a L-shaped body 27 having a support member 28, which is fixed to the table 25, and a housing 29, which is at right angles to the support member 28 and extends outwardly from the table 25. The housing 29 supports a longitudinal slide 30. The slide 30 is urged toward the center of the table 25 by a spring 31, which is captured between a head 32 on the inboard end of the slide 30 and a longitudinally adjustable shoulder 33 which defines the inboard end of the housing 29. The outboard end of the slide 30 includes a set screw 34 which retains an inwardly inclined spike 35. The spike 35 fits within the throughbore dowel passage 21 in the heel seat 17. The housing 29 has an outer edge 36 and an inclined surface 37 which terminates at the slide entrance 38. The inclined surface 37 and the slide 30 define a V-shaped slot which traps the heel lip 22 and, combined with the engagement of the spike 35 in the bore 21 fix the heel 11 rigidly in the jig 26. The heel 11 is released by moving the slide in the direction "B" against the action of the spring 31.

The internal shoulder 33 is formed in a bushing 39 which has a throughbore 40 which retains the spring 31 and through which the slide 30 moves. The bushing 39 fits into a counterbore 41 in the housing 29 and is longitudinally adjustable by a lateral pin 42 which is engageable in lateral openings 43 in the housing 29. The end of the bushing 39 engages the pin 42. The distance between the slide head 32 and the bushing shoulder 33 is adjustable to change the pressure on the spring 31 and consequently adjust the holding force on the heel 11 depending on the heel shape or size, and also to adjust the distance the spike 35 is beyond the end of the housing inclined end 37 to further accommodate different heel shapes and sizes.

Figure 4:
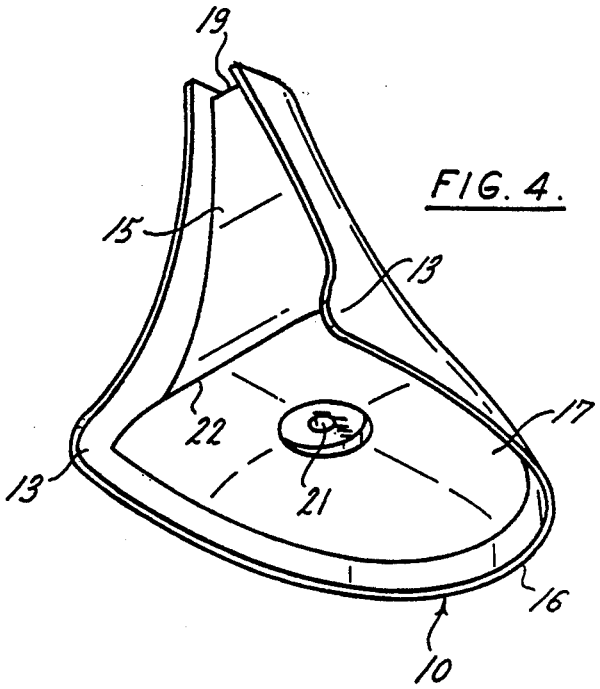
FIG. 4 is a perspective view of the heel and cover after it has been manually assembled in the first loading stations of the jig.

In the present process, the heel 11 first is placed in the jig 26 on the table 25 and the cover 10 is placed on the heel 11. Both the heel 11 and the cover 10 have previously been coated with contact cement and dried. The heel 11 usually is dipped and the cover 10 preferably is sprayed with contact cement. This "pulling" operation is still done manually and results in a heel and cover having the configuration of FIG. 4. The lower ears 13 are then pinched together, but no trimming or application of the cover 10 to the heel breast 15, heel seat 17 or the heel top area 19 has occurred. The foregoing operations occur at stations numbered 1 and 2 on the table 25 which are designated loading stations.

Figure 5:
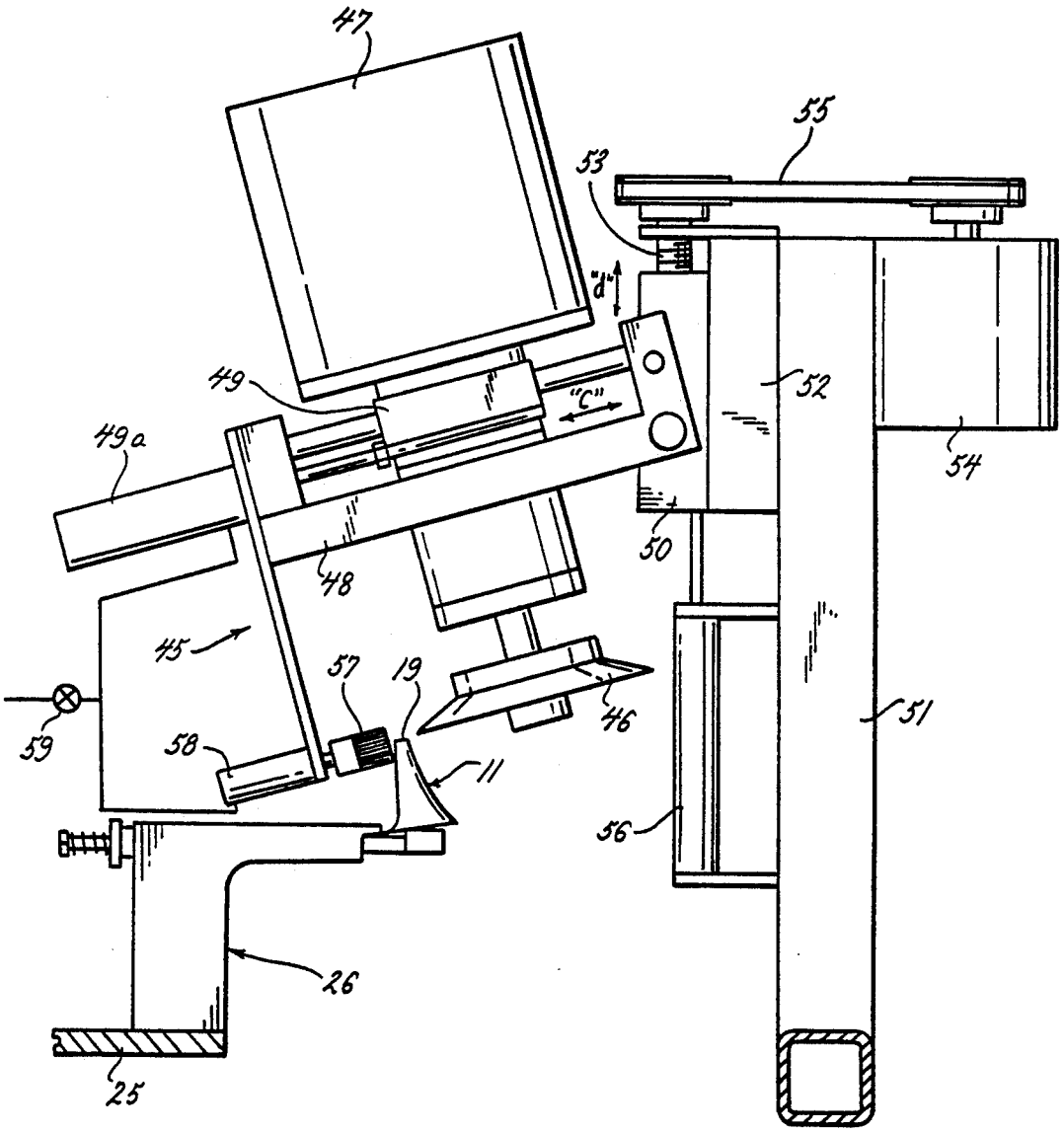
FIG. 5 is a fragmentary side elevational view partly in section and partly schemmatic of the top trimming station and apparatus.

Following the "pulling" operation is what is called the "blade off" station. This station is shown in FIG. 5 and includes a cutting assembly 45 comprising a spinning cutting blade 46 driven by an electric cutting or blade motor 47. The blade 46 is both vertically and horizontally movable with respect to the workpiece. The blade 46 and motor 47 are mounted on a housing 48 which is vertically adjustable with respect to the workpiece. The blade 46 and motor 47 are horizontally slidable along the housing 48 by means of a linear bearing 49 and reciprocate along the arrow "c" in FIG. 5. The reciprocation is controlled by a double action air cylinder 49*a*.

The blade 46 and motor 47 are vertically movable with a slide 50 which is mounted on a support stand 51. The housing 48 is fixedly positioned on the slide member 50. The slide 50 moves vertically along path "d" in a track in member 52. The linear motion is controlled by a screw drive 53 which is motor driven by motor 54 and belt 55. The motor 54 is programmable to compensate for different sizes and styles of heels.

The position of the adjustment gear motor 54 is sensed by a linear potentiometer 56 which is part of the computer controlled operating system which will be described more fully hereinafter.

The blade 46 moves along a line which is aligned with the inclination of the shoe heel top 19 as it is fixed in the jig 26.

The function of this station is to trim the excess cover material at the heel top 19 so that what is left can be neatly laid over the heel top 19 and held in place when the heel lift 12 is applied as a final step in the covering process as will be described hereinafter.

The blade 46 cuts into an air controlled brush 57 to ensure a clean cut. The brush 57 is controlled by a two way double action air cylinder 58 which is coordinated with the cylinder 49*a* and both are controlled by the same valve 59. The air line is connected to the front of the cylinder 49*a* and to the rear of the cylinder 58 so that the cylinders move the brush 57 and the blade 46 in opposite directions.

Compressed air also is blown through the brush 57 to aid in removing any fragments of the heel cover formed in the cutting operation.

Figure 6:
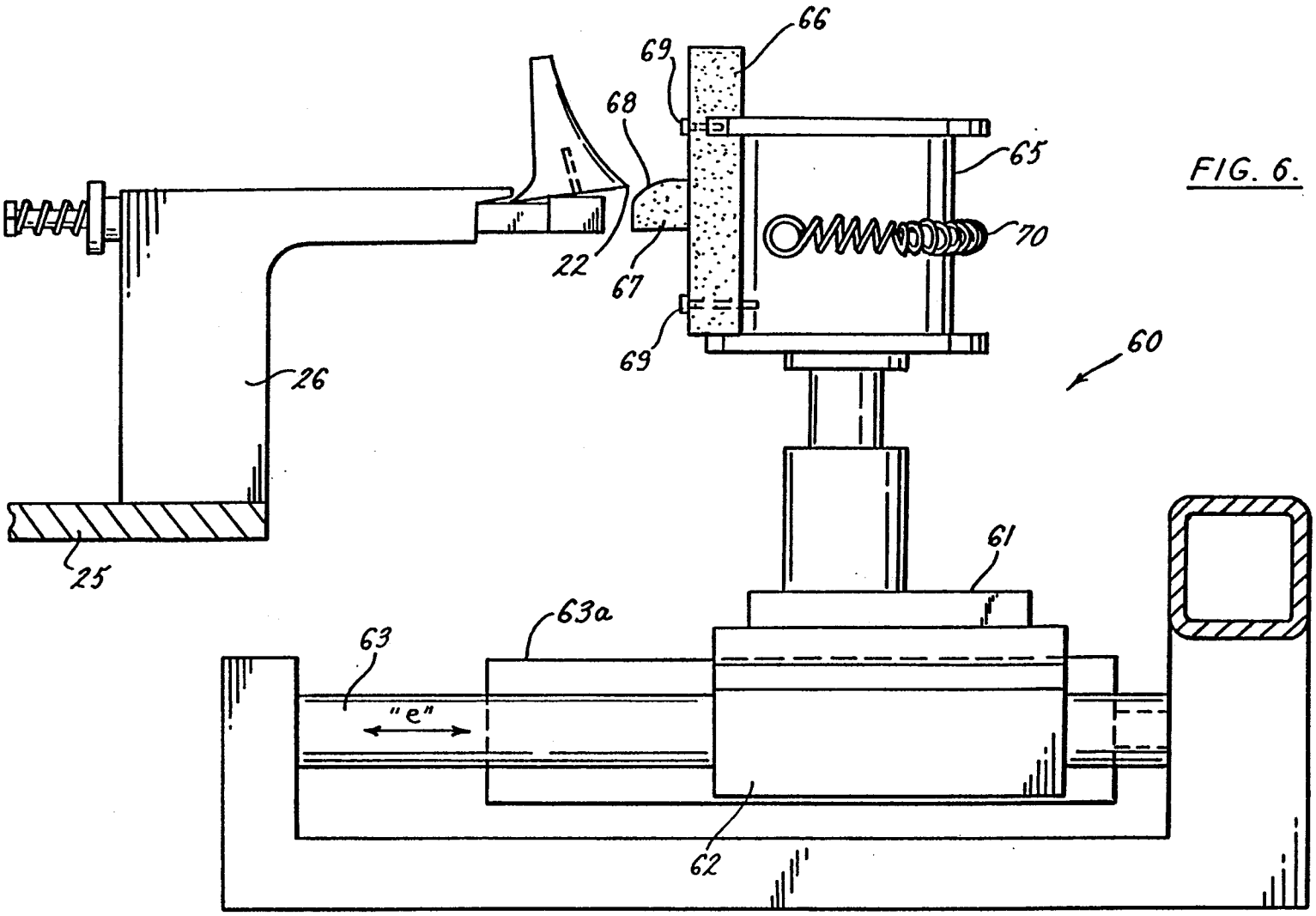
FIG. 6 is a fragmentary side elevational view partly in section and partly schemmatic of the seat rolling station and apparatus.

The next step in the process occurs at the "seat rolling" station. In this station, the edge 16 of the cover 10 that extends outwardly from the heel seat 17 is rolled over and firmly attached to the heel seat 17. The station comprises a seat roller 60 (FIGS. 6 & 6A & 6B) which is movable toward and away from the table 25 and jig 26. The seat roller 60 includes a base 61 laterally movable on a linear bearing 62 in the direction of the arrow "e". The bearing 62 is positioned on a shaft 63 and is moved by an air cylinder 63*a*.

The seat rolling mechanism itself comprises the base 61 which supports two laterally adjustable and freely rotatable cylinders 65. Positioned between the cylinders 65 and movable with them is a resilient deformable rubber pad 66 having an outwardly projecting resilient deformable lip 67 which has a curved upper surface 68.

Figure 6B:
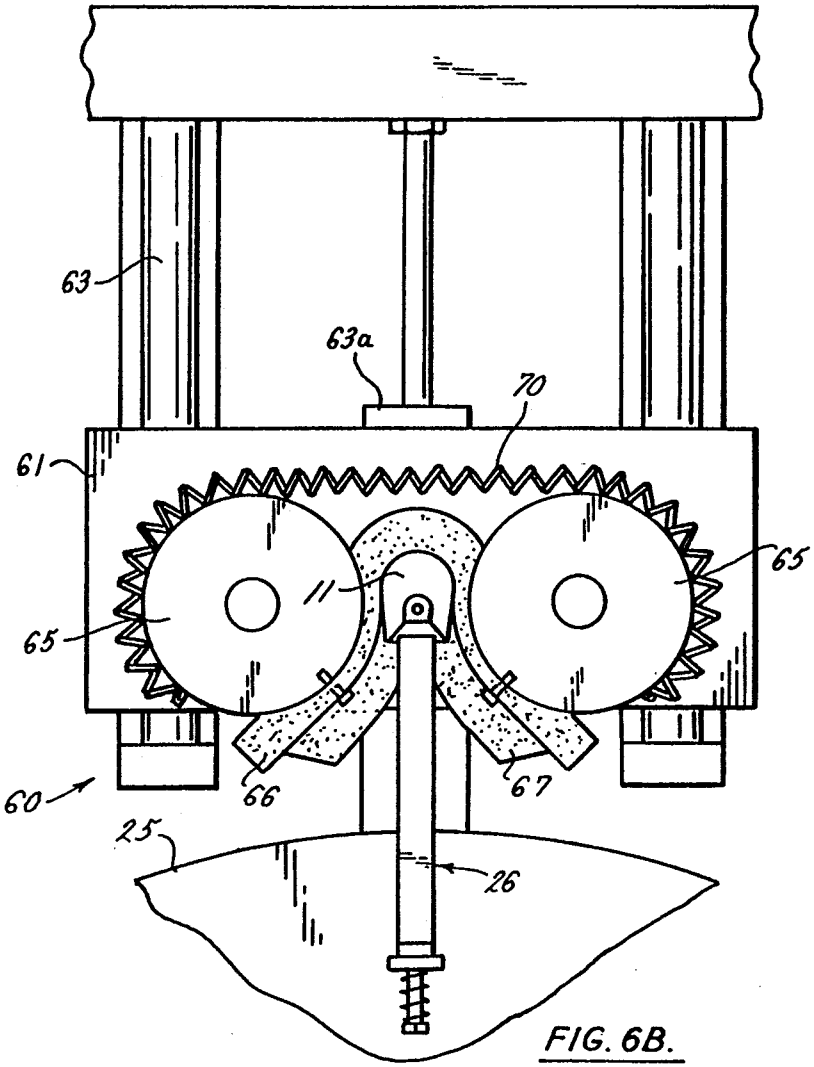
FIG. 6B is a fragmentary plan view of the seat rolling station with the heel engaged with the rollers and pad.
Figure 6A:
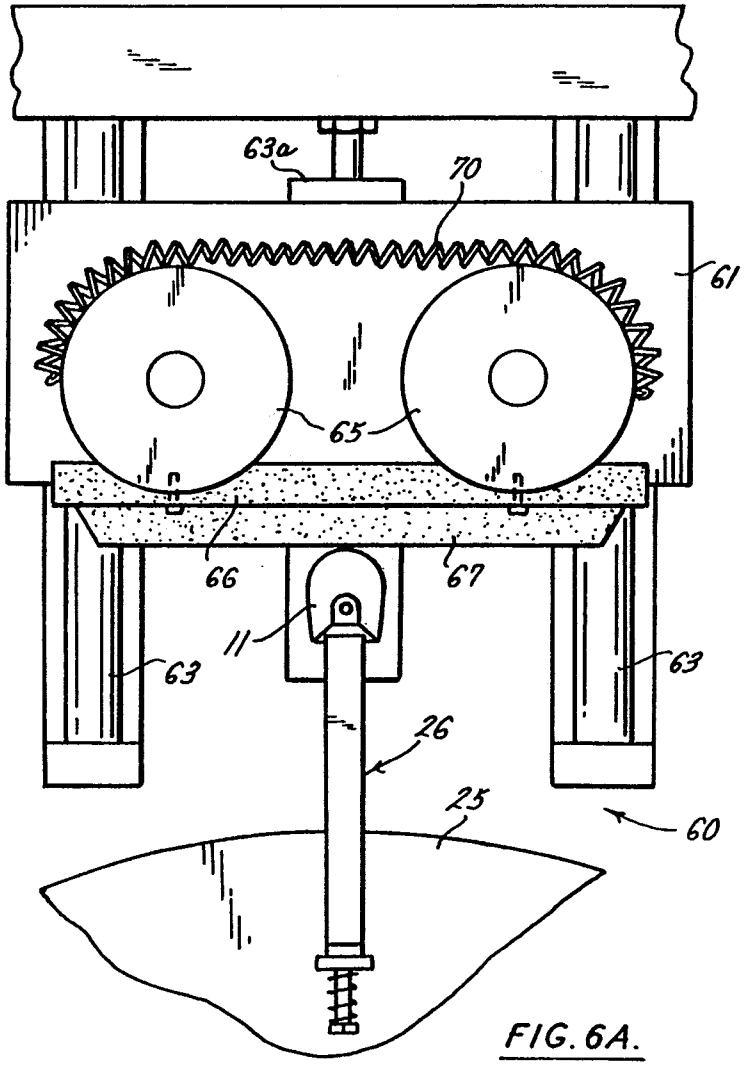
FIG. 6A is a fragmentary plan view of the seat rolling station before the heel is engaged.

The pad 66 is attached to the rollers 65 by fasteners 69. The rollers 65 are fastened to a return spring 70 so that the spring 70 is tensioned when the pad 66 is distended as the heel 11 is forced between the rollers 65 during the rolling operation (FIG. 6B). The spring 70 returns the cylinders 65 to their original position (FIG. 6A) and also returns the pad 66 to its starting position after the heel 11 is withdrawn.

In the rolling operation, the pad 66 and lip 67 are moved against and around the heel 11 after being positioned so that the curved portion 68 of the lip 67 engages the heel lip 22 and then is forced over the heel seat 17 to flatten the cover edge 16 down against the heel seat 17.

The pad 66 and lip 67 are of a resilient deformable material such as polyurethane, silicone rubber, etc., having a Durometer of about 60 to about 70 Shore D.

Figure 8:
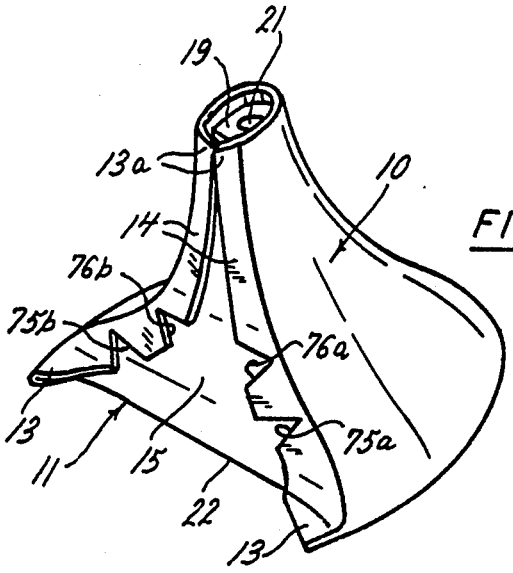
FIG. 8 is a perspective view partly in detail of a heel and cover after notching and breast folding.
Figure 7:
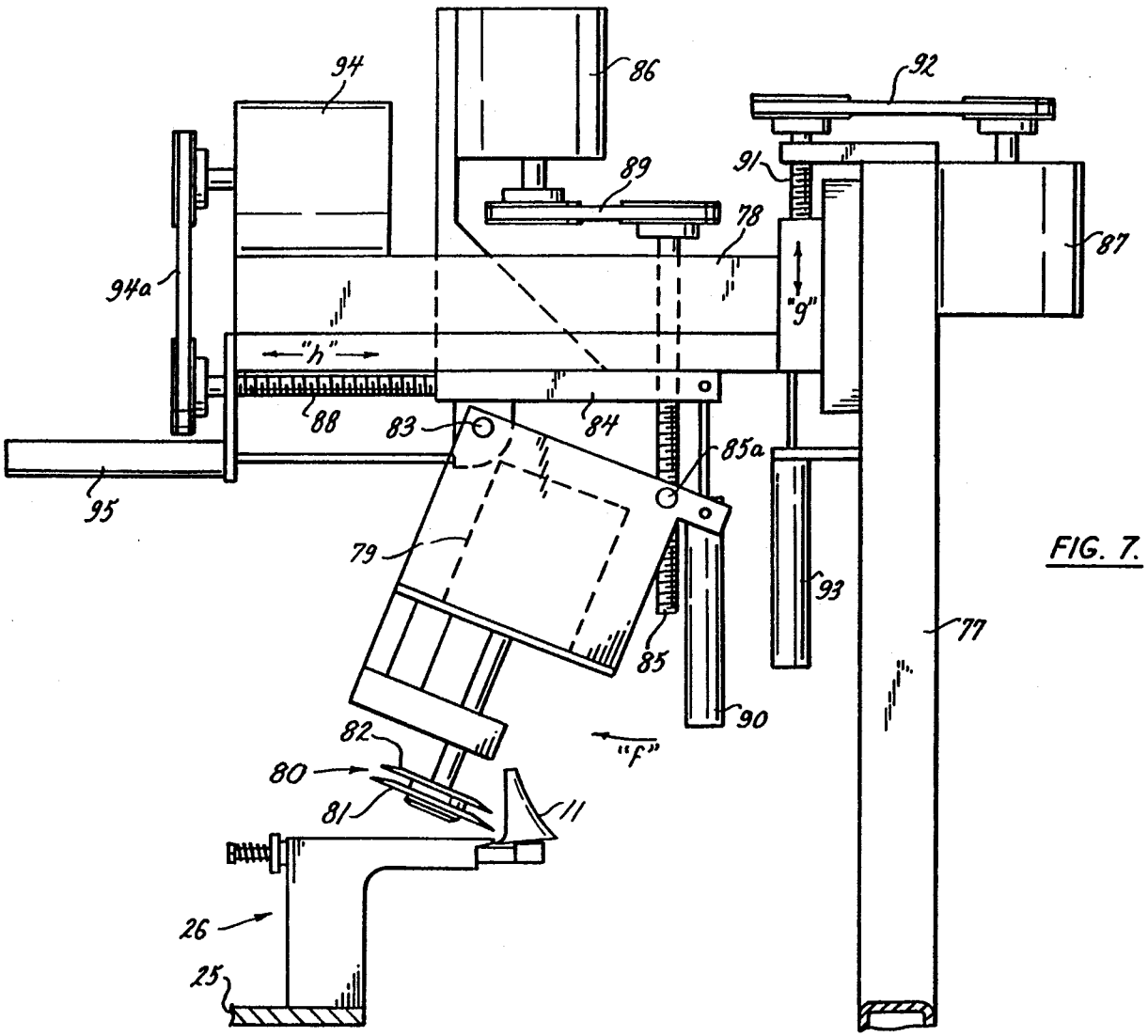
FIG. 7 is a side elevational view partly in section and partly schemmatic of the breast notching station and apparatus.

The next step in the process is the breast notching station shown in FIG. 7 in which the heel cover 10 shown in FIG. 8 is slit in four places in the breast area 14 so that the material may expand by forming triangular openings 75*a*, 75*b*, 76*a*, and 76*b* and be glued down to the heel breast 15. After the cover 10 is notched and after the breast area 14 has been glued to the heel breast 15, the heel and cover have the appearance of FIG. 8.

The actual breast notching apparatus (FIG. 7) includes a fixed support member 77 having a vertically movable suspending arm 78 on which is mounted a cutting or blade motor 79 which drives a double bladed cutter 80.

The heel notching apparatus is located midway between stations 5 and 6 and breast notching occurs as the heel moves between these stations.

The lower of the blades 81 is slightly larger in diameter than the uppermost blade 82. As the heel 11 held in the jig 26 is passed by the cutter 80, the blades 81 and 82 cut the slots which form the notches 75*a*, 75*b* and 76*a*, 76*b* respectively.

The cutter 80 is adjustable in three directions with respect to the jig 26. It is angularly adjustable around the pivot 83 which is fixed to a horizontally movable carriage member 84 on the arm 78. The angular adjustment "f" is made possible by a screw drive 85 pivotally connected at 85*a* to the motor 79 opposite the connection 83. The rod screw drive or adjustment 85 is longitudinally movable along its axis by the adjustment gear motor or motorized drive means 86 and the belt 89. A linear potentiometer 90 measures the movement of the screw drive 85.

The vertical adjustment "g" is accomplished by a vertical adjustment gear motor or motorized drive 87, screw drive 91 and drive belt 92 which drives the arm 78 vertically along the support 77. A linear potentiometer 93 measures the height of the arm 78.

The horizontal adjustment is accomplished by a screw drive 88 which moves the carriage member 84, to which the motor 79 is pivoted, along the arm 78 in the directions of the arrows "h". The drive rod 88 is operated by an adjustment gear motor 94 and a drive belt 94*a*. A linear potentiometer 95 measures the location of the carriage 84.

At this time in the process (after notching), a manual operation occurs. The operator manually folds the breast area 14 of the heel cover 10 against the heel breast 15 and attaches the cover to the heel top 19, while forming ears at the top and bottom of the breast area on each side of the heel breast 15. In other words, ears are formed at the edges of the seat area and at the heel top area. The heel seat ears 13 and the heel top ears 13*a* now must be trimmed.

At this point, the heel 11 and cover 10 are breast notched, the cover has been attached at the heel seat and the heel cover top, and the top has been trimmed. Also the cover has been attached to the heel breast and the heel top and ears formed at these areas.

Figure 9:
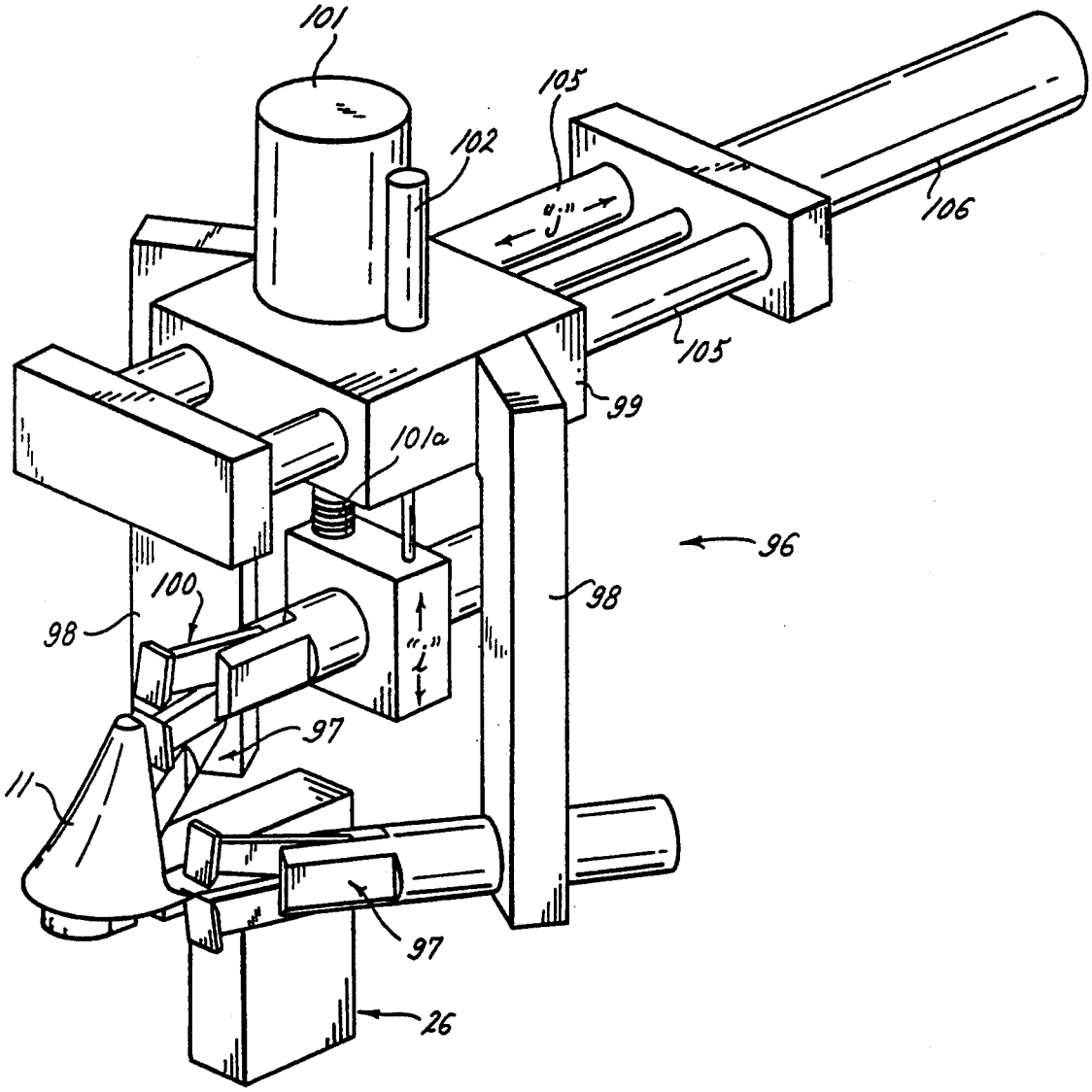
FIG. 9 is a perspective view partly schemmatic of the upper and lower ear cutter assemblies.

The next step is to trim the excess material from the pinched together top ears 13*a* and the bottom ears 13. This is done at the nipper station by an upper and lower ear trimmer assembly 96 (FIG. 9). The ear trimmer assembly 96 comprises a pair of lower ear cutters 97 which are angularly positioned with respect to each other and are designed to cut the lower ears 13. These are mounted on bracket arms 98 which are fixed to a cutter assembly body 99 and are fixed in a vertical position and are aligned with the lower ears 13 on the breast area of the heel 11. Also supported by the body 99 is an upper ear cutter 100 which is vertically movable with respect to the lower cutters 97. The upper cutter 100 is moved in a vertical direction "i" by an adjustment gear motor 101 which operates a screw drive 101*a*. The position of the upper cutter 100 is sensed by a linear potentiometer 102. The entire assembly 96 is moved longitudinally toward and away from the heel 11 on a pair of linear bearing shafts 105 by an air cylinder 106. This movement is indicated by the arrow "j" in FIG. 9. The cutters 97 and 100 are commercially available air energized nippers.

The final step in the heel is to apply the dowel and lift 12. This is a very important step, as the dowel can become loosened in use if not driven in absolutely straight and in proper alignment with the heel 11. Also, if the dowel 12 is forced into the heel throughbore 21 with too much force, it can squeeze the heel cover out between the lift and the heel top. This sequence is shown in FIGS. 10–13.

Figure 10:
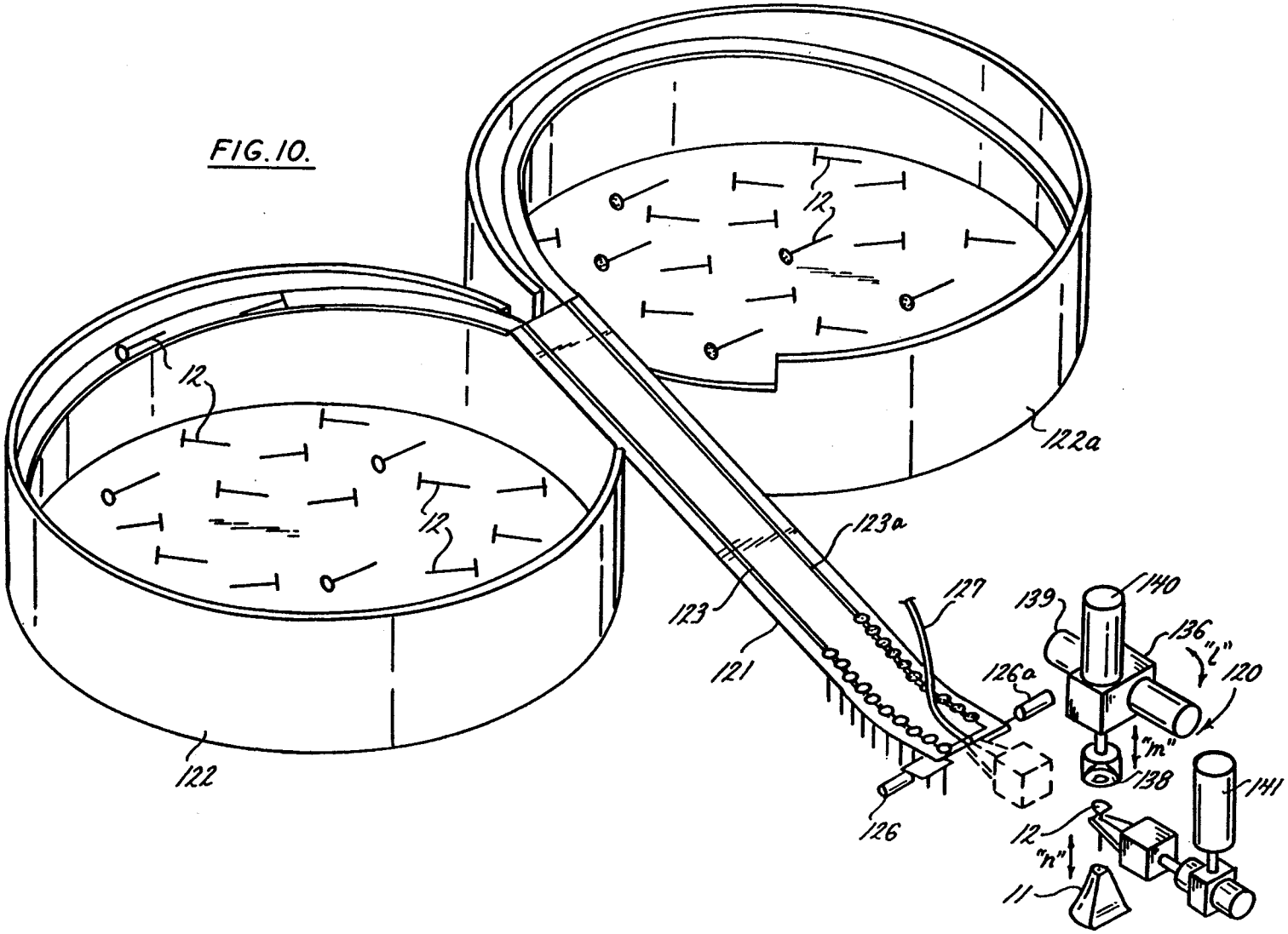
FIG. 10 is a perspective view partly schemmatic of the dowel feed, orientation, and insertion into the heel operations.

The first step in this operation is to feed the lift and dowels 12 to a gripping and orientation assembly 120 from a vibrating feeder 121. This is shown in FIG. 10.

The feed assembly 121 has two bowl feeders 122 and 122*a* which contain different style or size dowel and lifts 12. Thus changes in the heels being assembled can be accommodated more quickly. The dowel and lifts 12 travel in separate tracks 123 and 123*a* from the bowls 122, 122*a* to the gripping assembly 120.

Figure 11:
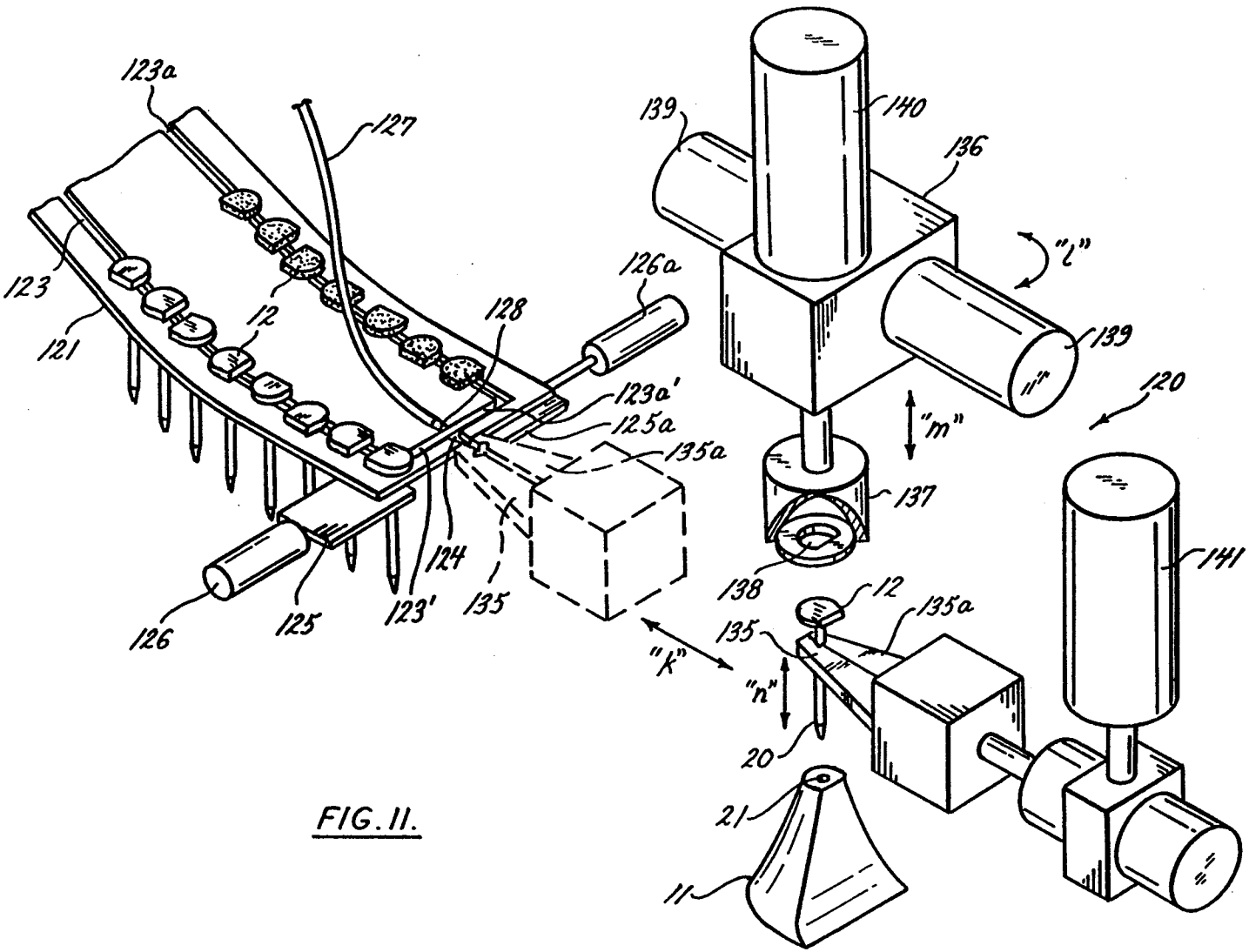
FIG. 11 is an enlarged fragmentary perspective view, partly schemmatic of the dowel orientation and seating operation shown in FIG. 10.

As shown in FIG. 11, the heel lifts 12 proceed down the tracks 123, 123*a* in a random orientation, i.e., the lift portion may be facing in any direction. The tracks 123, 123*a* have inturned portions 123', 123*a'* at their ends. The inturned portions 123', 123'*a* terminate in an outlet 124 where the lifts 12 are delivered to the gripping and orientation assembly 120. The lifts 12 are moved along the inturned portions by pusher slides 125, 125*a* which are actuated by air cylinders 126, 126*a*. When lifts are being delivered from one track, e.g., track 123 in FIG. 11, the opposed pusher slide 125*a* is moved across the end of the track 123*a* and into the inturned portion 123*a*' to block the track 123*a* and deny the lifts 12 in this track access to the outlet track 124.

A compressed air hose 127 having an outlet 128 is aligned with the outlet track 124. Thus, when the pusher slide 125 delivers a lift 12 along the track 123' to the outlet track 124, compressed air is discharged through the hose outlet 128 to tap the lift 12 into a set of gripper jaws 135, 135*a* which close on the lift 12 in whatever orientation it is in and retract it along the arrow "k" in FIG. 11 into alignment with a 360° rotary actuator 136. This is a commercially available item and includes a head 137 having a lift engaging cut-out 138 at its working end. An air cylinder 140 moves the actuator 136 vertically (arrow "m") until it engages the lift 12. Then air cylinders 139 rotate the actuator 136 into alignment with the lift 12 (arrow "l"). When the cutout 138 and the lift 12 are aligned, the cutout 138 engages the lift 12. The actuator 136 then is returned to a preset home or start position where the heel lift 12 is aligned with the heel 11.

The gripping and orientation assembly 120 then is moved downwardly (arrow "n") by the air cylinder 141 to position the dowel 20 in the heel throughbore 21 in condition to be fixedly seated therein.

Figure 12:
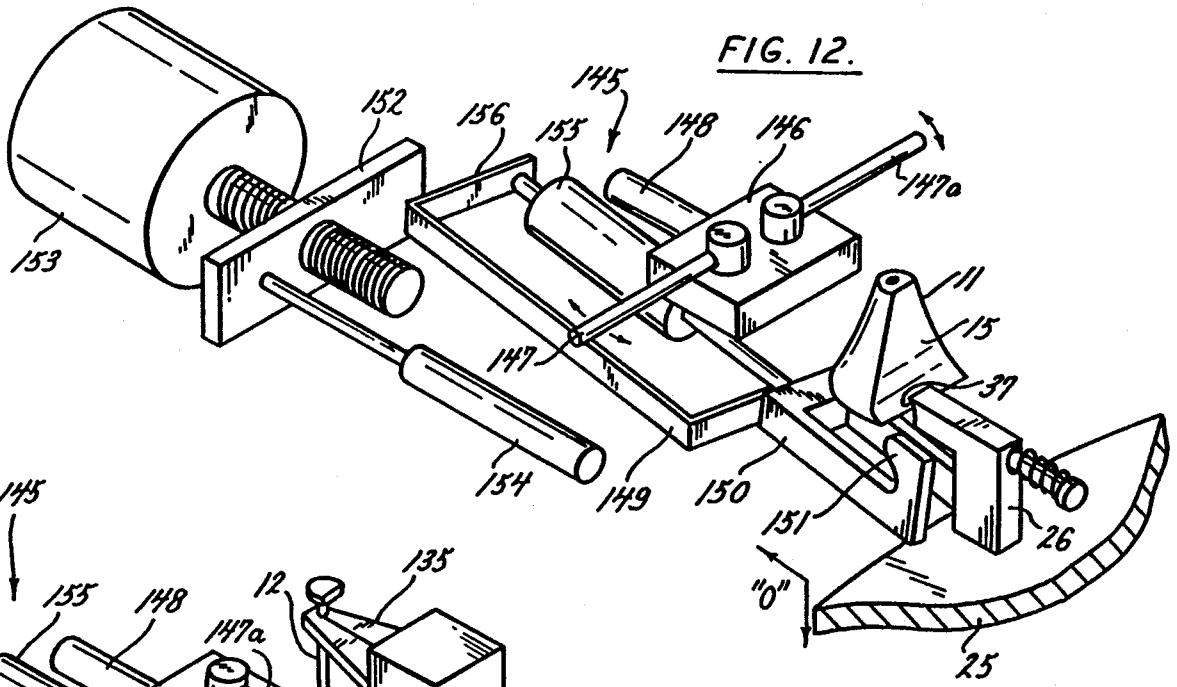
FIG. 12 is a fragmentary perspective view partly schemmatic of the heel holding apparatus for inserting the dowel.
Figure 12A:
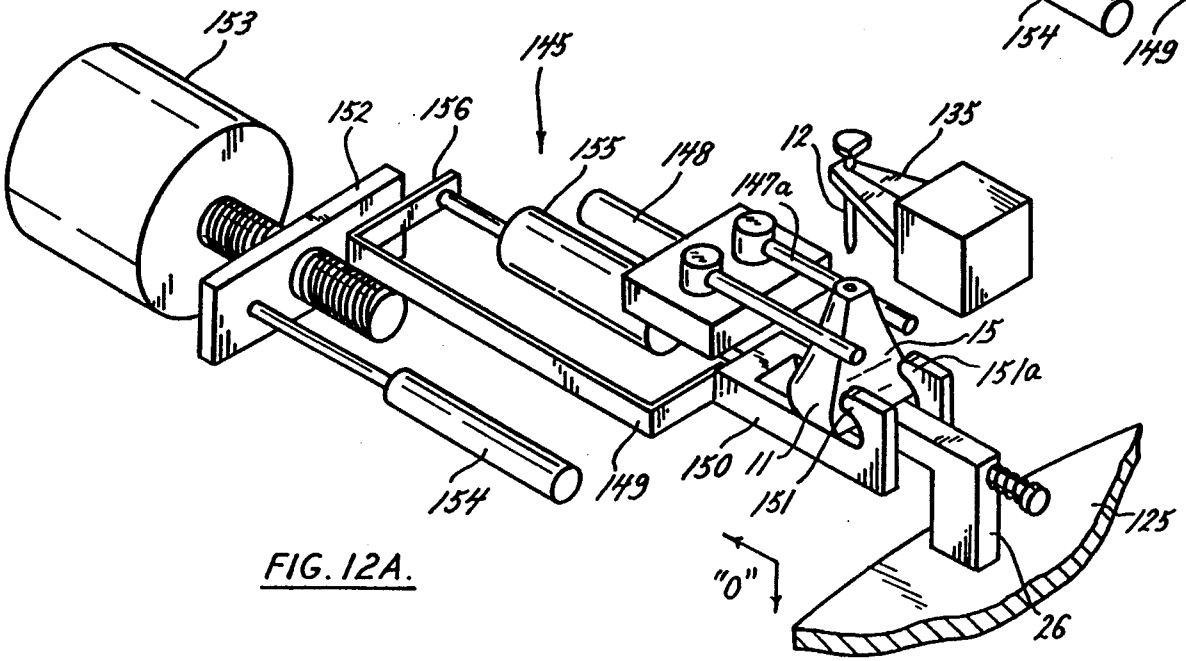
FIG. 12A is a fragmentary perspective view partly schemmatic of the heel in the heel holding apparatus shown in FIG. 12.

It is important that the heel 11 be firmly gripped during the positioning and seating of the dowel 20, and mechanism for doing this is shown in FIGS. 12 and 12A. FIG. 12 shows the heel 11 in its unclamped position, held only by the jig 26. In the dowel applying step, the heel 11 is withdrawn from the U-shaped slot formed by the inclined surface 37 and the slide 30 and is gripped in a heel clamping assembly 145. The heel clamping assembly 145 has an upper clamp 146 which includes rotatable arms 147, 147*a* which rotate toward each other to trap the heel 11 and center it. The arms 147, 147*a* are operated by an air cylinder 148. A bottom clamp 149 includes a carriage 150 which has opposed reversely open carriage jaws 151, 151*a* which clamp against the heel breast 15. The carriage 150 and the carriage jaws 151, 151*a* have a vertical and horizontal motion indicated by the arrow "o" as it moves upwardly and toward the heel 11 as shown in FIGS. 12 and 12*a*.

The rearward motion of the bottom clamp 149 is determined by an adjustable limit plate 152 which is driven by a reversible adjustment gear motor 153 and sensed by a linear potentiometer 154.

A double ended air cylinder 155 operates the bottom clamp 149. When the bottom clamp 149 is drawn rearwardly toward the heel 11, its travel is stopped when the clamp frame 156 engages the limit plate 152. The bottom clamp jaws 151, 151*a* are designed so that they clear the jig 26 when the plate 25 rotates.

In operation, the bottom clamp 149 and the top clamp 146 grasp the heel 11 to center it beneath the dowel 12 which is held in the gripping jaws 135, 135*a*. When the jaws 135, 135*a* position the dowel 12 in the opening 21, the jaws 135, 135*a* retract at the same time that the upper clamp arms 147 are rotated into the open position of FIG. 12 and the bottom clamp 149 is moved forwardly and downwardly to again position the heel 11 in the slot between the slide 30 and the inclined surface 37.

Figure 13:
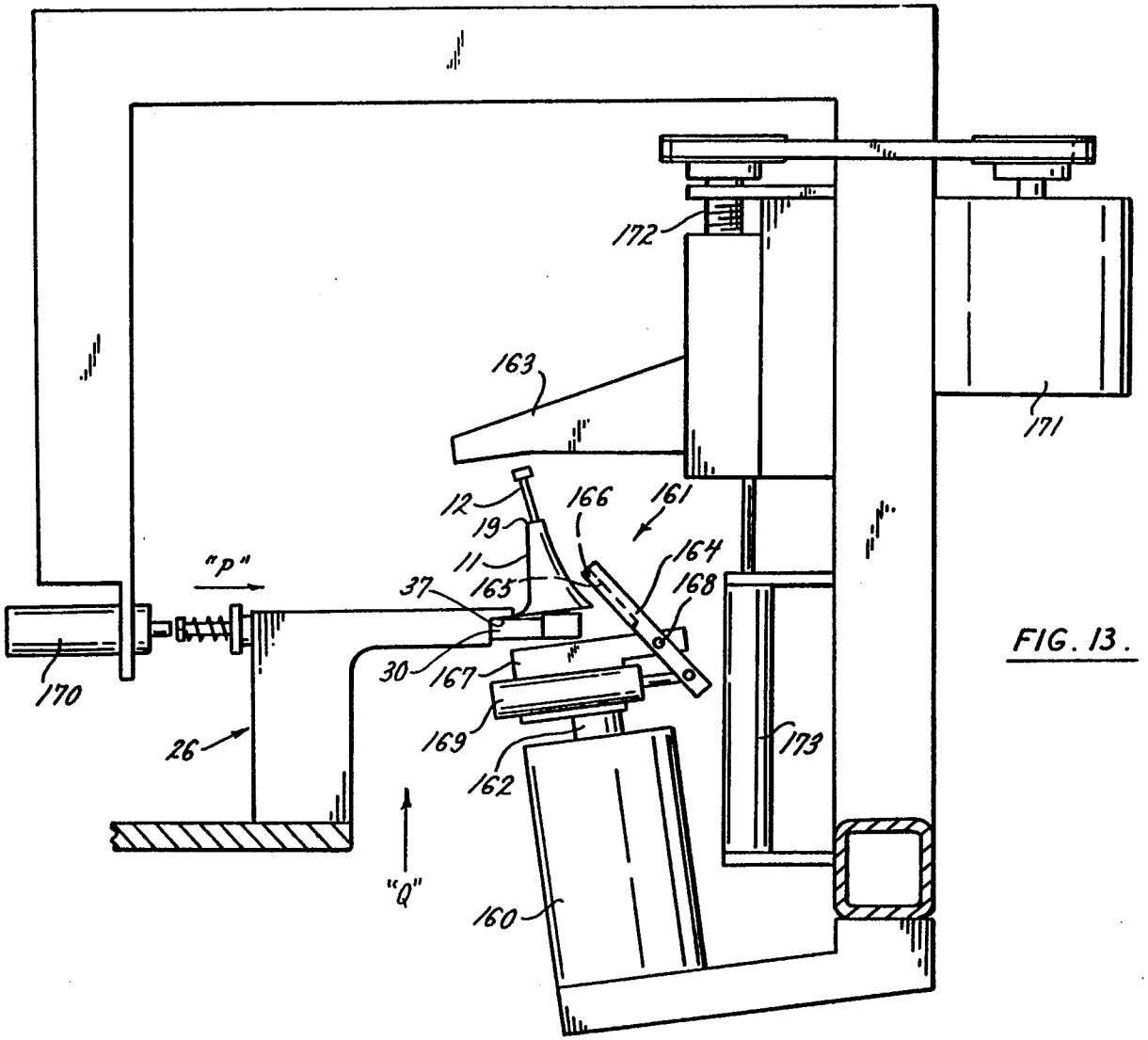
FIG. 13 is a fragmentary side elevational view partly in section and partly schemmatic of the dowel inserting apparatus.

The final operation is seating the dowel 20 in the throughbore 21 and this is shown in FIG. 13. In this process an air cylinder 160 having a heel clamping assembly 161 on the rod 162 is used to force the dowel and lift 12 against an adjustable end stop or anvil 163 with just the right amount of movement to keep from forcing leather out between the lift 12 and heel top 19. The clamping device 161 includes a clamp 164 having a cup shaped heel engaging surface 165 which is provided with a scuff pad 166 for engaging the heel 11 without damage thereto. The clamp 164 is pivotably connected inbetween its ends to a housing 167 at 168 and is positioned by an air cylinder 169. The heel 11 is freed from the housing edge 37 and is urged against the clamp 164 by an air cylinder 170 which operates on the slide 30 to move it in the direction of the arrows "p" in FIG. 13.

The air cylinder 169 is then activated to clamp the heel 11 while the air cylinder 160 is simultaneously activated to lift the heel 11 off of the jig 26 in the direction of arrow "Q". The heel 11, dowel and lift 12, and clamping assembly 161 move along arrow "Q" until the air cylinder 160 reaches the end of its stroke. The end stop 163 is positioned such that the dowel and lift 12 will be properly seated in the heel 11 when the air cylinder 160 stops moving. Location of the end stop 163 is determined, depending on the style and size of the heel 11, by an adjustment gear motor 171 which operates on a screw drive 172 and is sensed by a linear potentiometer 173.

After seating the dowel and lift 12, the heel 11 is released by retracting the air cylinders 169 and 160 simultaneously to their initial positions. During the downward movement of the air cylinder 160, the heel 11 with the seated dowel and lift 12 freely falls into a box of finished parts.

Figure 14:
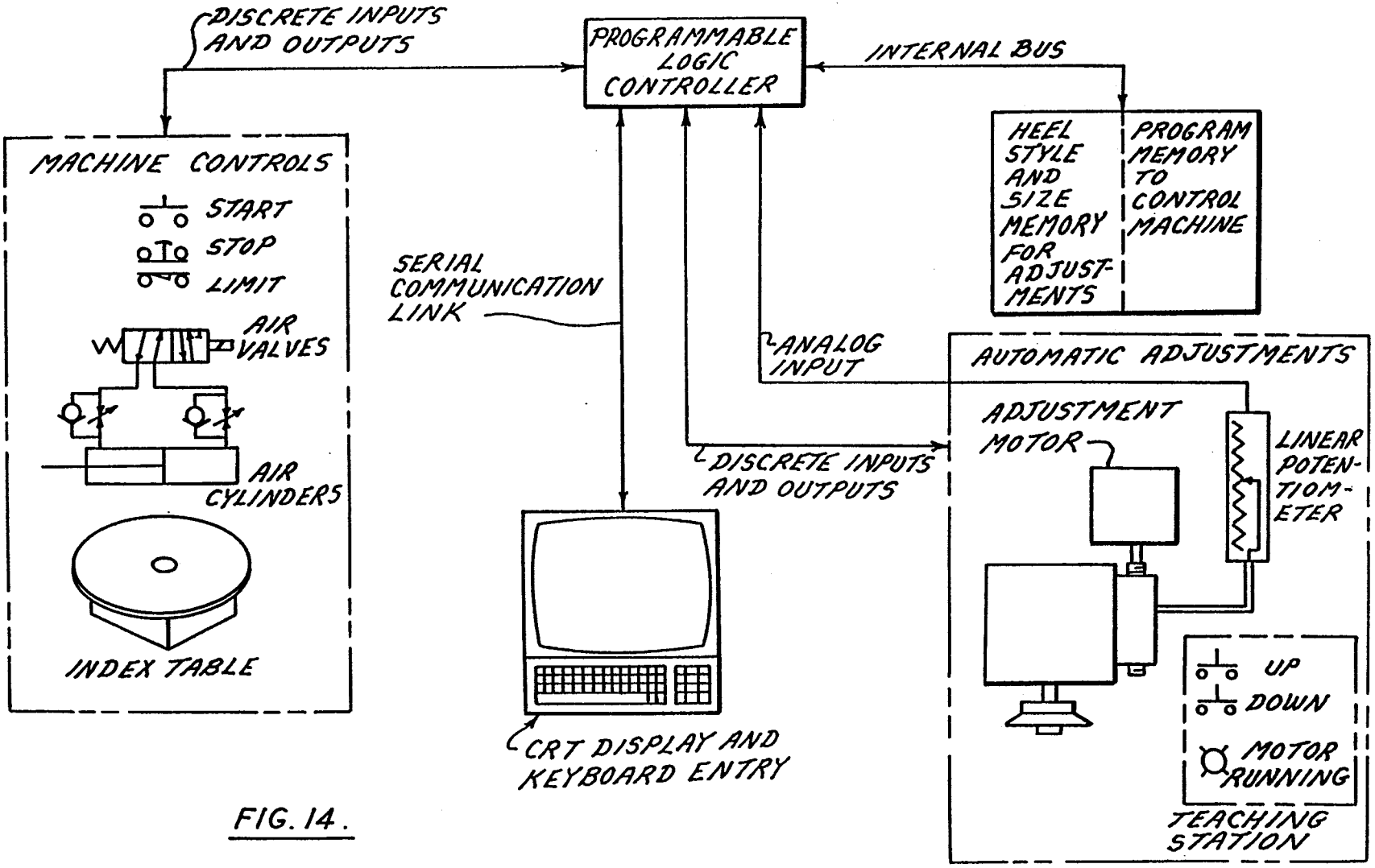
FIG. 14 is a schemmatic of the program controller system.

FIGS. 14–16 show schematically the operation of the control, adjustment and teaching functions of the system.

FIG. 14 shows the overall system with CRT display and keyboard entry used by the operator to enter a specific heel size and style into the programmable logic controller. If the specific style and size already has been programmed, the computer will operate the specific machine at each of the seven adjustable axes on the machine until it is told that a different size or style has been entered onto the machine. It will operate the machine controls and the automatic adjustments whenever it is told what the specific heel size and style is at a specific station. Once a specific style and size heel is entered into the machine at a specific station, the controller will operate the air cylinders and the motor to perform the programmed operation at that station.

A unique feature of this invention is that the machine can be programmed to handle new heel sizes and styles while the machine is running. Touch-up adjustments for existing heels are also handled in the same manner. This concept is shown schematically in FIG. 16.

This feature is significant because, historically, teachable robotic type apparatus must be stopped and taken out of run mode before teaching can begin. In teach mode, a pendant with push-buttons is typically used to adjust locations, and then this information is stored temporarily in memory. Permanent storage requires taking further steps to preserve this information on a disk drive. If the machine is running production in a factory, changing modes is very annoying since it interrupts the operator's routine and halts the flow of work. It can be so disruptive as to cause operators to neglect making changes and instead cause the machine to produce marginal or reject parts, all for the sake of convenience.

To improve the state of the art, the subject machine is designed so that it is always in teach mode, even while running production work. The control system tracks the movement of heels around the machine, and knows which size and style are at each station at all times. The teach pendant is actually a series of push-buttons permanently located at each of the programmable stations as shown in FIG. 14. Pushing any of these buttons initiates a teaching sequence that moves the selected motor, and permanently stores the new position when the operator is done moving the motor. Disruption is kept to a minimum, and operator training is also simplified.

A typical adjustment of a station when a different, but preprogrammed, heel arrives is shown schemmatically in FIG. 15. This logic is used on each of the seven adjustable axes on the machine. Additionally, since each axis uses its own logic, each station's position is independent of the other stations and allows many sizes of heels to be on the machine at the same time.

These potentiometers and motors are low cost, easily maintainable, standard items of commerce.

This invention is intended to cover all changes and modifications of the example of the invention herein chosen for purposes of the disclosure which do not constitute departures from the spirit and scope of the invention.

What is claimed is:

1. A method of teaching adjustments to an adjustment gear motor having a position sensed by a linear potentiometer at a station in a machine for operating on an article without stopping the machines comprising the steps of (a) starting the machine, (b) activating a selected adjustment gear motor at a selected station, (c) moving the motor to a desired position while continuing the operation of the machine, (d) stopping the motor, (e) reading a linear potentiometer to determine the location of the motor, and (f) placing the reading into the machine memory with the identification of the article, while continuing operation of the machine.

2. A method of teaching motor adjustments to an adjustment gear motor having a position sensed by a linear potentiometer in a heel covering machine without stopping the machines comprising the steps of (a) starting the machine, (b) depressing an adjustment button for a selected motor at a station, (c) moving the motor to a desired position while continuing the operation of the machine, (d) releasing the adjustment button and stopping the motor, (e) reading a linear potentiometer to determine the location of the motor, and (f) placing the reading into the machine memory with the identification of the heel style and size, while continuing operation of the machine.

* * * * *